US005176090A

United States Patent [19]

Roberts et al.

[11] Patent Number: 5,176,090

[45] Date of Patent: Jan. 5, 1993

[54] RECYCLABLE PAPER PALLET

[75] Inventors: Mark Roberts; Richard C. Miller, both of Lawrence, Kans.

[73] Assignee: Lawrence Paper Company, Lawrence, Kans.

[21] Appl. No.: 836,757

[22] Filed: Feb. 19, 1992

[51] Int. Cl.[5] ..... B65D 19/00

[52] U.S. Cl. ..... 108/51.3; 108/56.1

[58] Field of Search ..... 108/51.1, 52.1, 53.1, 108/56.1

[56] References Cited

U.S. PATENT DOCUMENTS

| | | | |
|---|---|---|---|
| 2,696,356 | 12/1954 | Baumann | 108/51.3 |
| 3,000,603 | 9/1961 | Hemann | 108/51.3 |
| 3,069,059 | 12/1962 | Debois | 108/55.1 |

*Primary Examiner*—Kenneth J. Dorner
*Assistant Examiner*—Gerald A. Anderson
*Attorney, Agent, or Firm*—Hovey, Williams, Timmons & Collins

[57] ABSTRACT

A lightweight, completely recyclable paper pallet (10) is provided which can be produced, shipped and stored as two die cut pieces (24, 26), and which can be readily constructed without gluing to form a complete pallet (10). Preferably, the pallet (10) includes a planar main panel (12) having a pair of laterally spaced apart, side marginal, box-like underlying support sections (18, 20); a box-like central support section (22) coupled to the main panel (12) completes the construction. Interconnection of the marginal support sections (18, 20) and central support section (22) is accomplished by means of notched locking elements (106–120, 174–188) passing through strategically located slots (38–60) in main panel (12) and interfitting with upright notched reinforcing panels (70–84, 140–146) provided along the length of the supports (18, 20, 22).

8 Claims, 3 Drawing Sheets

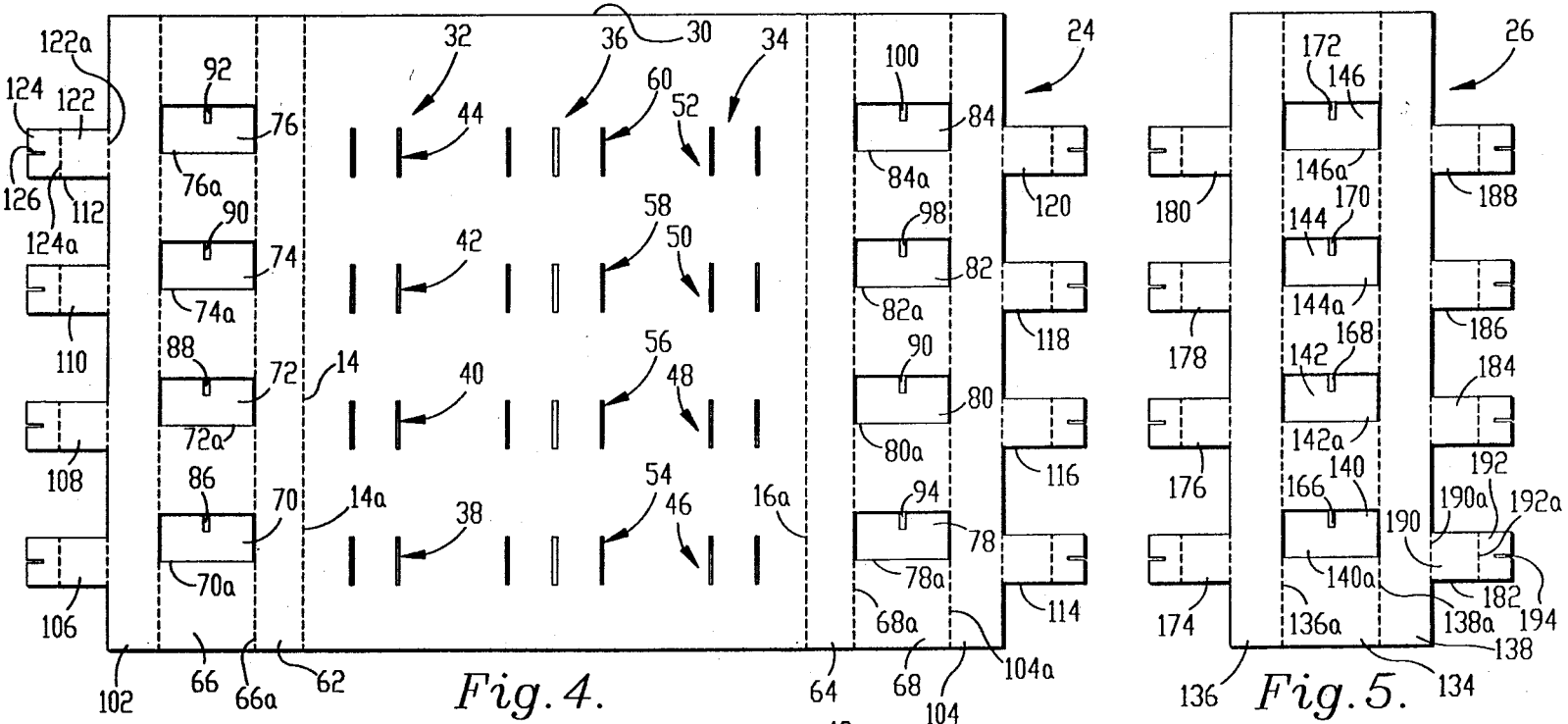
Fig. 5.
Fig. 4.
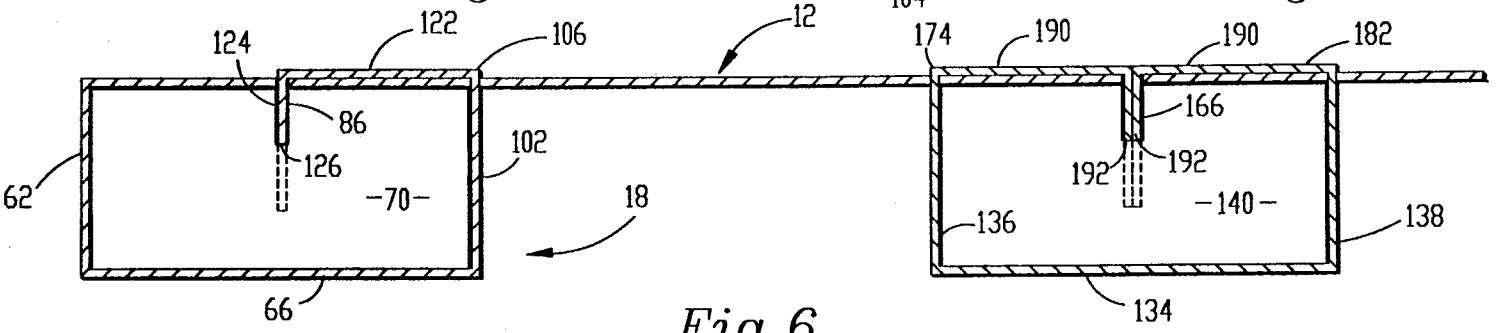
Fig. 6.

RECYCLABLE PAPER PALLET

BACKGROUND OF THE INVENTION

1. Field of the Invention

The present invention is broadly concerned with a lightweight pallet fabricated entirely from recyclable paper (e.g., cardboard) which can be quickly constructed without gluing and which has an extremely favorable weight to load-bearing capacity. More particularly, it is concerned with such a paper pallet which can be shipped and stored as two die cut and scored cardboard pieces, thereby eliminating excess volume, with the pieces being readily interconnectable to form a complete pallet construction.

2. Description of the Prior Art

Users of conventional wooden pallets are faced with a number of increasingly expensive problems. For example, damaged and no longer usable wooden pallets can not generally be taken to a landfill or other waste disposal site. Rather, they must be reduced, either by chipping or burning before disposal. Chipping is a significant problem inasmuch as nails and other metal fasteners must be removed from the pallet wood before the chipping operation can be undertaken. By the same token, increasingly stringent environmental regulations often preclude burning of used pallets.

It has been proposed in the past to fabricate pallets composed largely or entirely of corrugated cardboard material. For example, a pallet construction commercialized under the designation "Buckboard" includes an apertured, flat main panel with a plurality of depending, synthetic resin cup-like legs attached to the main panel. These units are deficient in that they are not completely recyclable, owing to the presence of the synthetic resin legs.

Another type of prior cardboard pallet commercialized under the designation "Payload" includes a plurality of transverse cross-rails with three separate supports beneath the rails. Although this unit is entirely recyclable, experience has proven that it is very time-consuming and difficult to fabricate. Moreover, the cost of such pallets is considerable, on the order of a good used wooden pallet. As such, this unit likewise presents real-world problems for a pallet user.

SUMMARY OF THE INVENTION

The present invention overcomes the problems outlined above, and it provides a relatively inexpensive, fully recyclable pallet of improved design permitting ready fabrication thereof from only two initially flat, die cut and scored cardboard pieces. The completed pallet can be provided with a number of holding capacities, starting at 3,200 pounds.

Broadly speaking, the pallet of the invention includes a body presenting an upper article-supporting main panel having a pair of opposed side margins and a pair of underlying, marginal, support-defining sections joined to and extending from the opposed side margins. Each of the support sections includes a plurality of panels cooperatively defining a box-like support at the side margins of the main panel. Specifically, each support section includes an upright end panel directly joined to and depending from a corresponding main panel side margin, a surface-engaging bottom panel generally parallel with the main panel and extending inwardly from the end panel, and an upright connector panel extending upwardly from the bottom panel and generally parallel with the end panel. In order to provide adequate strength, reinforcing panel(s) are provided which extend upwardly from the bottom panel between the end and connector panels; these reinforcing panels are transverse to the end and connector panels respectively. In order to complete the construction, means is provided for operatively maintaining each of the support sections beneath the main panel.

In particularly preferred forms, a separate, box-like, interconnectable central support is provided between the marginal supports and is likewise connected to the main panel at the central region thereof.

In order to facilitate construction of the pallet of the invention, an interlock arrangement is provided which eliminates the need for gluing or other expedients. Specifically, the main panel is slotted to provide a plurality of slot pairs proximal to each side margin thereof. In addition, a like plurality of elongated, notched locking elements extend from the upper surface of the connector panels of each support section, with each of these locking elements extending through both of the slots of the adjacent pairs and downwardly into the confines of the box-like marginal support. The previously described reinforcing panels are also notched intermediate the ends thereof, so that the notched ends of the locking elements interfit with the notches provided in the reinforcing panels. In this way, a secure interconnection is assured for maintaining the marginal support sections beneath the main panel.

In like manner, the preferred central support is interconnected to the main panel by appropriate slots in the central area of the main panel and corresponding, notched locking extensions and reinforcing panels in the central support.

BRIEF DESCRIPTION OF THE DRAWINGS

FIG. 4 is a plan view of the main panel portion of the pallet of the invention;

FIG. 5 is a plan view of the central support portion of the pallet of the invention; and FIG. 6 is a fragmentary sectional view illustrating the interlocking connection of the marginal and central supports of the pallet to the main panel.

DESCRIPTION OF THE PREFERRED EMBODIMENT

Figure 1:
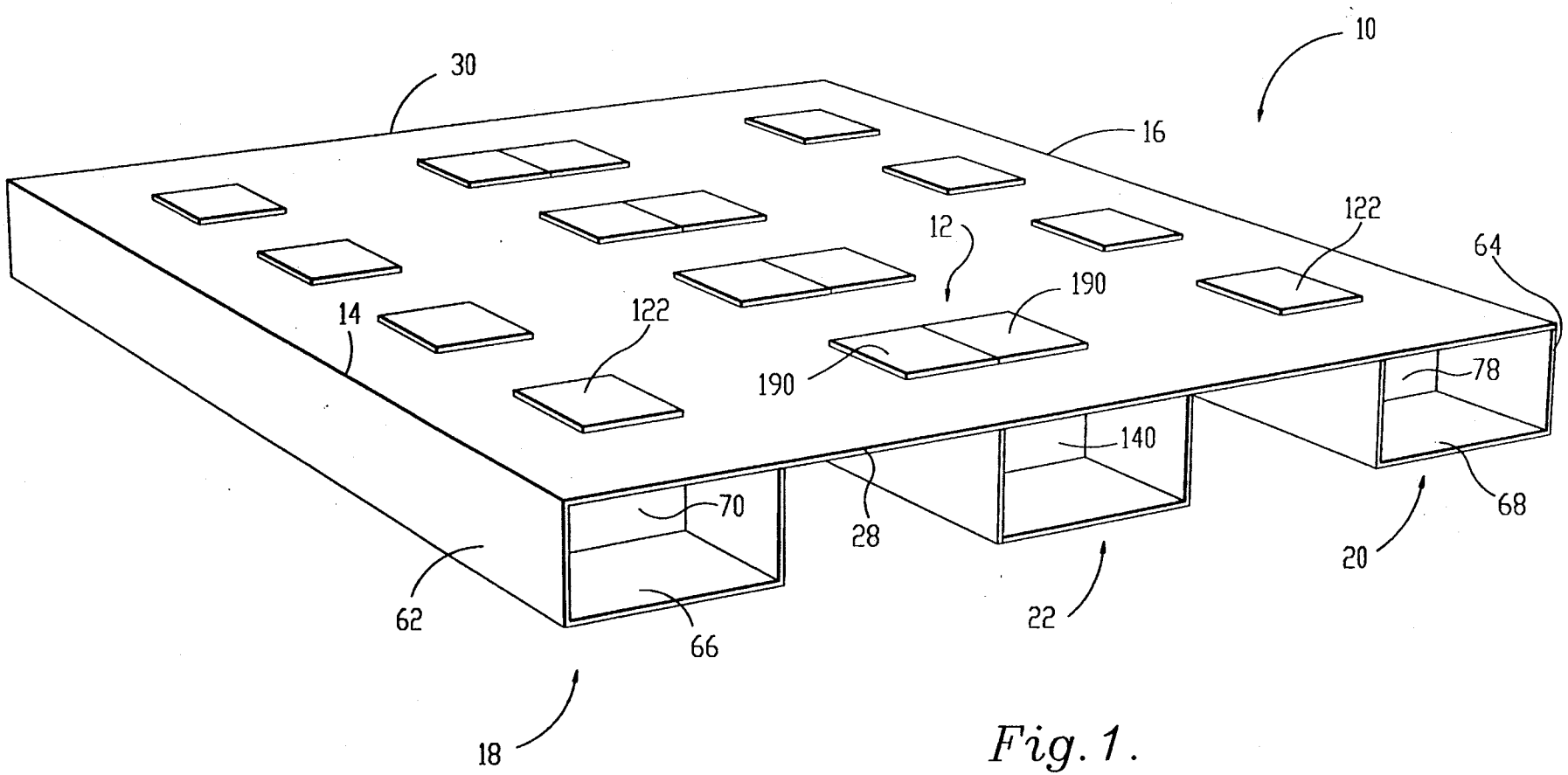
FIG. 1 is an isometric view of the preferred pallet of the invention.

Turning now to the drawings, and particularly FIG. 1, a recyclable pallet 10 formed entirely of corrugated cardboard is depicted. Broadly speaking, the pallet 10 includes a planar main panel 12 presenting opposed side margins 14, 16, as well as laterally spaced apart, side marginal, box-like support sections 18 and 20. In addition, the preferred pallet 10 includes an elongated, box-like central support section 22. The complete pallet 10 is fabricated using only two cardboard pieces, namely a main panel piece 24 (FIG. 4), and a central support piece 26 (FIG. 5).

In more detail, it will be observed that the main panel 12 is generally rectangular in plan configuration, and presents opposed forward and rearward edges 28, 30 as well as the side margins 14, 16. In addition, the main panel 12 is provided with two marginal slot sets 32, 34, and a central slot set 36. Specifically, the slot set 32 includes a total of four pairs 38–44 of laterally spaced apart slots, and similarly the set 34 includes four pairs 46–52 of laterally spaced apart slots. The central slot set 36 is made up of four slot subsets 54–60, with each such subset including a pair of relatively widely spaced apart slots similar in dimension to the slot pairs 38–52, as well as a central, somewhat wider slot (see FIG. 4).

The support sections 18, 20, each include a depending, imperforate end panel 62, 64, which is joined to the main panel 12 throughout the length of the associated side margins 14, 16 along fold lines 14*a*, 16*a*. In addition, each of these support sections includes a bottommost panel 66, 68 joined to a corresponding end panel 62, 64 along fold lines 66*a*, 68*a* and extending inwardly therefrom. The bottom panels are also provided with a total of four spaced apart, upright, die cut reinforcing panels 70–76 (bottom panel 66) and 78–84 (bottom panel 68). The side margins and top edge of each of these reinforcing panels 70–84 are die cut from the corresponding bottom panel, whereas the bottom edge of each of the reinforcing panels is connected to the corresponding bottom panel by appropriate fold lines 70*a*–84*a*. Each of reinforcing panels 70–84 also has an integrally formed, central panel locking notch 86–100 (FIG. 4). The support sections 18, 20 further have an inboard upright connector panel 102, 104 secured to the panels 66, 68 along appropriate fold lines 102*a*, 104*a*. A series of four elongated, spaced-apart locking elements 106–120 are attached to the outermost edges of each panel 102, 104. Each locking element is identical and has a central section 122 extending outwardly from the associated panel 102 or 104 along a fold line 122*a*. Each element 106–120 also has a locking section 124 secured to the central section 122 along fold line 124*a*, with the section 124 being centrally notched at 126.

Turning now to FIG. 5, central support piece 26 includes central bottom panel 134 and respective side panels 136, 138 secured to panel 134 along fold lines 136*a*, 138*a*. Central bottom panel 134 presents four spaced-apart, upright, die-cut central reinforcing panels 140–146. The side margins and the top edge of each central reinforcing panel 140–146 are die-cut from the central bottom panel, whereas the bottom edge of each central reinforcing panel is connected to the central bottom panel by appropriate fold lines 140*a*–146*a*. Central reinforcing panels 140, 146 are also formed with central locking notches 166–172 having a width (FIG. 6) sufficient to accommodate a double thickness of cardboard material. The piece 26 also presents along the length of each panels 136, 138, four locking elements 174–188. These elements are identical with the elements 106–120 described previously. Specifically, each locking element 174–188 includes a central section 190 joined to a respective panel 136, 138 along fold line 192*a*; additionally, an outermost locking section 168, attached to the central section 166 along fold line 168*a*, completes each locking element. Note in this respect that each of the locking elements is also centrally notched as at 194.

Figure 2:
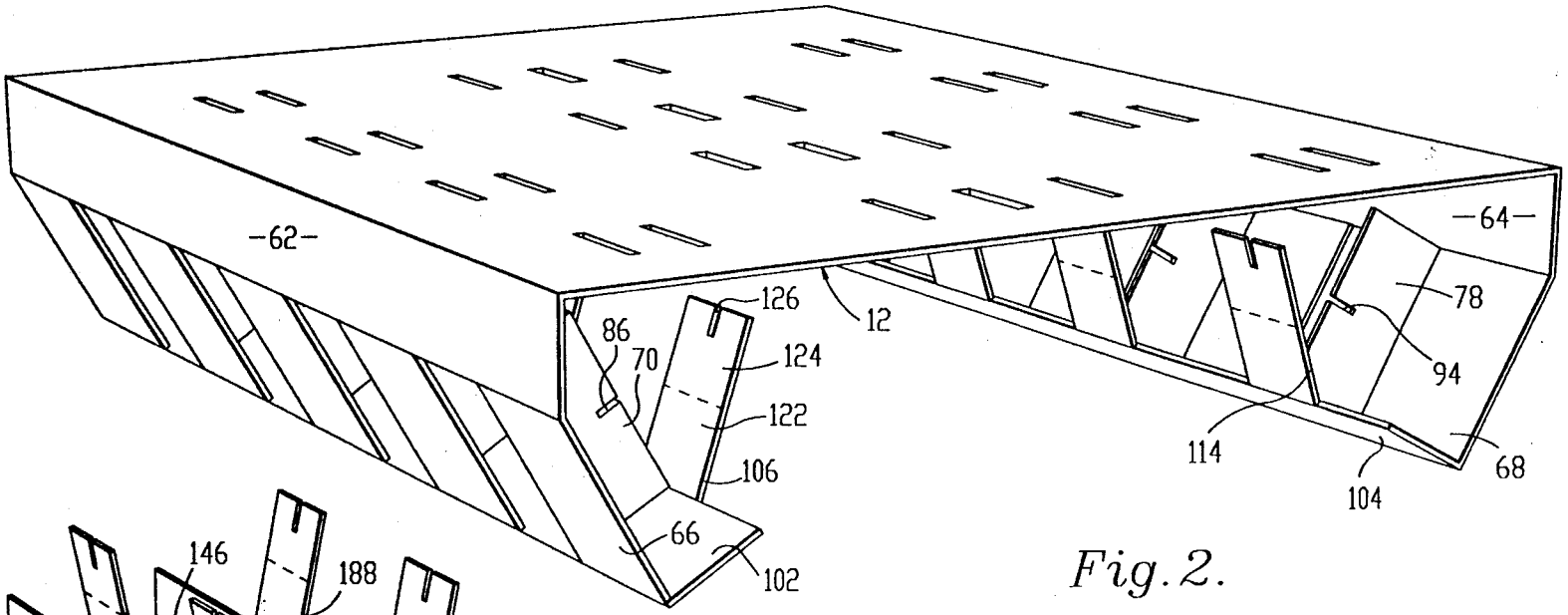
FIG. 2 is an isometric view illustrating the main panel of the pallet of FIG. 1, shown during formation and interlocking of the underlying marginal supports thereof.

FIG. 2 depicts piece 20 and the support sections 18, 20 in the first stage of assembly of the pallet 10. In the first step, the end panels 62, 64 are folded downwardly along respective fold lines 14*a*, 16*a*, and the bottom panels 66, 68 are folded inwardly along lines 66*a*, 68*a*. Next, the reinforcing panels 70–84 are pulled upwardly along fold lines 70*a*–84*a*, and the connector panels 102, 104 are likewise pulled upwardly along fold lines 102*a*, 104*a*. The associated locking elements 106–120 are then folded as necessary along fold lines 122*a*, and are guided into the innermost slots of the associated slot pairs 38–52. This has the effect of forming the box-like supports 18 and 20 adjacent the side marginal edges of the main panel 12.

In order to lock the supports 18, 20 in place, the respective locking elements are folded over and outwardly so that the central sections 122 thereof overlie the main panel 12. Also, the endmost connection sections 124 are folded downwardly along fold lines 124*a* and are inserted into the outermost associated slot of the slot pairs 38–52. Final locking is accomplished by interfitting of the locking sections 122 with the underlying reinforcement panels 70–84. Such interfitting involves intercalation of the locking sections and reinforcing panels, until the notches 126 of the locking sections bottom out against the bottoms of the reinforcement panel notches 86–100. Such interfitting is specifically depicted in FIG. 6.

Figure 3:
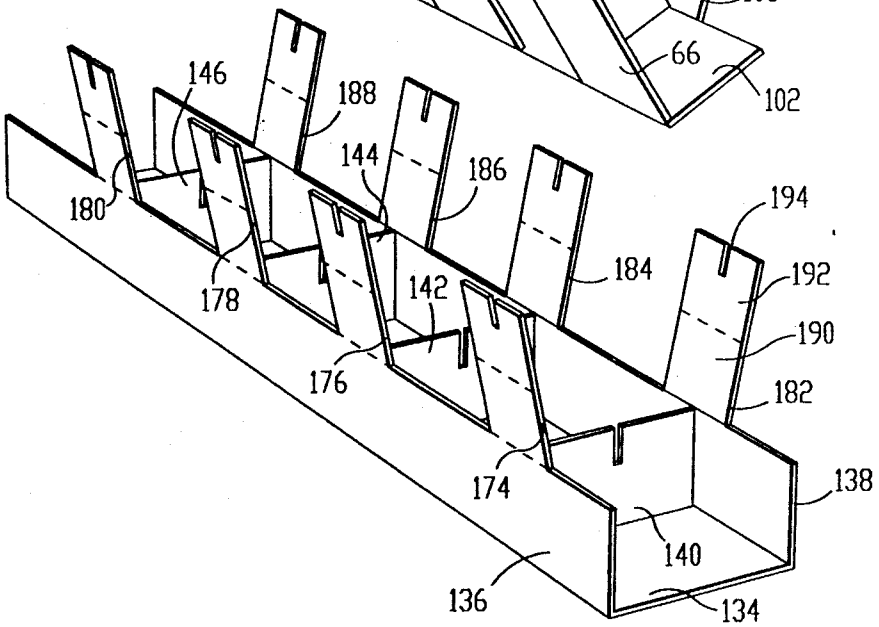
FIG. 3 is an isometric view illustrating the configuration of the central support portion of the pallet prior to interconnection thereof with the main panel.

Central support section 26 is next assembled (FIG. 3). Side panels 136, 138 are first bent upwardly along fold lines 136*a*, 138*a* to an upright orientation with central bottom panel 134. Central reinforcing panels 140–146 are next bent upwardly relative to bottom panel 134 along lines 140*a*–146*a*. The central section 26 is then placed between the supports 18, 20 in the region of slot subsets 54–60, and the respective locking elements 174–188 are used to interlock the central section with main panel 12. In particular, the locking elements 174–188 are pushed upwardly through the outermost, relatively narrow slots of each subset 54–60, whereupon the locking elements are bent downwardly along score lines 190*a* until the central sections 190 overlie the main panel 12. At this point, the locking sections 192 are bent downwardly along fold lines 192*a*, and the locking sections are pushed downwardly through the wider central slot of each slot subset. Final connection is effected by interfitting of the notches 194 of each opposed pair of locking elements within the notches 166–172 of the associated reinforcing panels. Again, the locking sections 192 and reinforcing panels are interfitted until the notches 194 bottom out within the reinforcing panel notches 166–172, the latter being of sufficient width to accommodate a pair of locking sections 168 (see FIG. 5).

The assembled pallet 10 is now ready for use, as depicted in FIG. 1. Various articles of great weight can be positioned on top of main panel 12 for moving and storage. A pallet constructed from 200# test C-Flute corrugated board was tested and it was determined that the vertical compression limitation was 3,225 pounds. A second pallet constructed of reclaimed double wall 7 core glued corrugated board was tested and found to have a vertical compression limitation of 5,000 pounds.

Pallets in accordance with the invention have a number of important advantages. First, they can be shipped and stored in a disassembled condition, using only a minimum of space. Assembly of a completed pallet can be accomplished in a very short period of time, thus minimizing the total cost of the pallet. When the pallet becomes unusable, it is completely recyclable, in contrast to many prior paper pallets

I claim:

1. A pallet adapted to lie upon a surface and support articles thereon, said pallet comprising:

a body presenting an upper, article-supporting main panel presenting a pair opposed side margins and having a pair of underlying, marginal, support-defining sections joined to and extending from said opposed side margins, each of said support-defining sections including an upright end panel joined to and depending from a corresponding main panel side margin, a surface-engaging bottom panel generally parallel with said main panel and extending inwardly from said end panel, an upright connector panel extending upwardly from said bottom panel and generally parallel with said end panel, at least one upright reinforcing panel between said end and connector panels and extending upwardly from said bottom panel toward said main panel and transverse to said end and connector panels; and means for operatively maintaining each of said support sections beneath said main panel, said support section-maintaining means comprising structure defining two pairs of spaced apart slots through said main panel and respectively located proximal to a corresponding support section, structure defining a locking notch in the upper end of a reinforcing panel of each support section, there being an elongated, notched locking element extending from the upper surface of the connector panel of each support section, each of said locking elements extending through both of the slots of the corresponding pair thereof and downwardly for interlocking of the notch of each locking element and the locking notch of the corresponding reinforcing panel.

2. The pallet of claim 1, wherein each of said support sections includes a plurality of said reinforcing panels extending along the length of said bottom panel and spaced from each other.

3. The pallet of claim 1, said body presenting, for each of said support-defining sections, three mutually parallel fold lines cooperatively presenting said end, bottom and connector panels, said reinforcing panel presenting top and side margins cut from said bottom panel, and a bottom margin secured to said bottom panel by a fold line transverse to said mutually parallel fold lines.

4. The pallet of claim 1, including a central support underlying said main panel and operatively secured thereto, said central panel including a pair of upright side panels and a bottom, surface-engaging panel.

5. A pallet adapted to lie upon a surface and support articles thereon, said pallet comprising:

a body presenting an upper, article-supporting, slotted main panel presenting a pair opposed side margins and having a pair of underlying, marginal support-defining sections joined to and extending from said opposed side margins, each of said support-defining sections including an upright end panel depending from a corresponding main panel side margin, a surface-engaging bottom panel generally parallel with said main panel and extending inwardly from said end panel, an upright connector panel extending upwardly from said bottom panel and generally parallel with said end panel, and an elongated locking element extending from said connector panel and through a pair of said main panel slots; and means for interconnecting each locking element with a connection portion of a support section for maintaining each of the support sections beneath said main panel, said interconnecting means including structure defining a locking notch in each of said locking elements, each of said locking notches interconnecting with a respective part of support-defining section.

6. The pallet of claim 5, each of said support sections including a notched reinforcing panel extending upwardly from said bottom panel and between said end and connector panels, the locking notch of the adjacent locking element interlocking with the notch of said support sections.

7. A pallet adapted to lie upon a surface and support articles thereon, said pallet comprising:

a body presenting an upper, article-supporting, slotted main panel presenting a pair opposed side margins and having a pair of underlying, marginal, support-defining sections joined to and extending from said opposed side margins, each of said support-defining sections including an upright end panel depending from a corresponding main panel side margin, a surface-engaging bottom panel generally parallel with said main panel and extending inwardly from said end panel, an upright connector panel extending upwardly from said bottom panel and generally parallel with said end panel, and an elongated locking element extending from said connector panel and through a pair of said main panel slots, said locking element presenting a segment overlying said main panel between said slots and a connection segment remote from said connector panel extending beneath said main panel; and means for interconnecting each connection segment with a part of a respective support-defining section at a point beneath said main panel, in order to maintain each of the support sections beneath said main panel.

8. The pallet of claim 7, said interconnecting means comprising structure defining a slot in each connection segment, each of said slots interfitting with a respective support-defining section part.

* * * * *